US005198604A

United States Patent [19]

Higashi et al.

[11] Patent Number: 5,198,604

[45] Date of Patent: Mar. 30, 1993

[54] RESONANT EFFECT APPARATUS FOR ELECTRONIC MUSICAL INSTRUMENT

[75] Inventors: Iwao Higashi; Yasuyuki Umeyama, both of Hamamatsu, Japan

[73] Assignee: Yamaha Corporation, Hamamatsu, Japan

[21] Appl. No.: 758,675

[22] Filed: Sep. 12, 1991

[30] Foreign Application Priority Data

Sep. 12, 1990 [JP] Japan ..... 2-242228
Sep. 12, 1990 [JP] Japan ..... 2-242229

[51] Int. Cl.[5] ..... G10H 7/00

[52] U.S. Cl. ..... 84/626; 84/DIG. 1; 84/DIG. 27; 84/662; 84/660

[58] Field of Search ..... 84/602, 615, 625, 626, 84/630, 653, 660, 662, 678, 697, 707, DIG. 1, DIG. 26, DIG. 27, 672, 675, 633, 665, DIG. 8

[56] References Cited

U.S. PATENT DOCUMENTS 4,909,121 3/1990 Usa et al. ..... 84/DIG. 9

*Primary Examiner*—William M. Shoop, Jr.
*Assistant Examiner*—Helen Kim
*Attorney, Agent, or Firm*—Spensley Horn Jubas & Lubitz

[57] ABSTRACT

A resonant effect apparatus for an electronic musical instrument includes a plurality of resonant tone signal forming channels for forming a plurality of resonant tone signals different in their resonant frequency characteristics when applied with a musical tone to be generated and a plurality of acoustic conversion systems for acoustically converting each of the resonant tone signals to issue the converted resonant tone signals therefrom. In the resonant effect apparatus, a supply condition of the resonant tone signals to the acoustic conversion systems is controlled for control of a sound localization of the resonant tone signals.

5 Claims, 5 Drawing Sheets

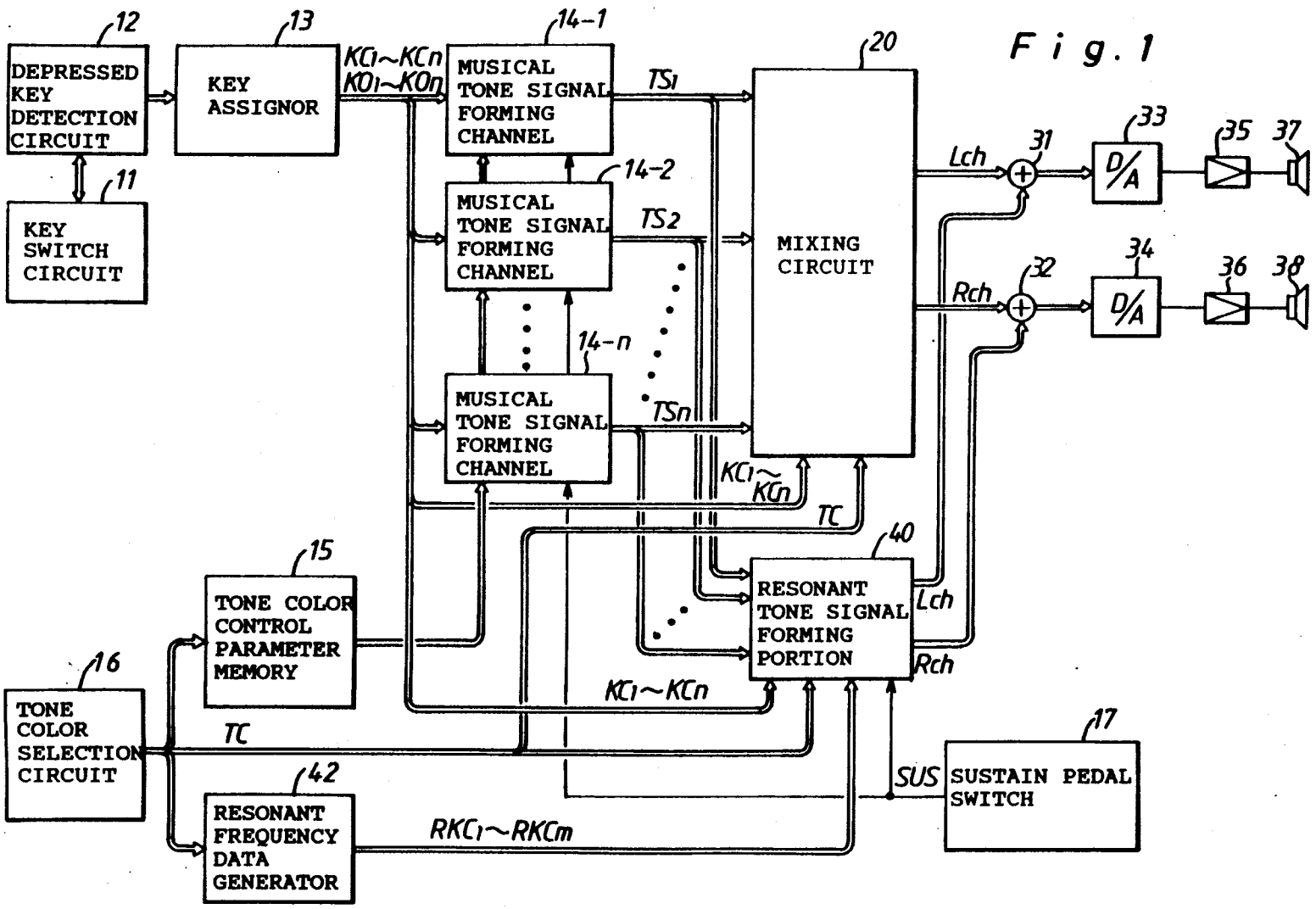
Fig. 1
DEPRESSED KEY DETECTION CIRCUIT
12
KEY SWITCH CIRCUIT
11
KEY ASSIGNOR
13
KC1~KCn
KO1~KOn
MUSICAL TONE SIGNAL FORMING CHANNEL
14-1
MUSICAL TONE SIGNAL FORMING CHANNEL
14-2
MUSICAL TONE SIGNAL FORMING CHANNEL
14-n
TS1
TS2
TSn
MIXING CIRCUIT
20
Lch
Rch
31
32
D/A
33
34
35
36
37
38
TONE COLOR SELECTION CIRCUIT
16
TONE COLOR CONTROL PARAMETER MEMORY
15
TC
RESONANT TONE SIGNAL FORMING PORTION
40
KC1~KCn
RESONANT FREQUENCY DATA GENERATOR
42
RKC1~RKCm
SUSTAIN PEDAL SWITCH
17
SUS

RESONANT EFFECT APPARATUS FOR ELECTRONIC MUSICAL INSTRUMENT

BACKGROUND OF THE INVENTION

1. Field of the Invention

The present invention relates to a resonant effect apparatus adapted for use in electronic musical instruments, and more particularly to a resonant effect apparatus for electrically providing resonant effects caused by a plurality of resonant elements such as piano strings.

2. Description of the Prior Art

In Japanese Patent Early Publication No. 63-267999, there has been proposed a resonant effect apparatus of this kind which includes a plurality of resonant tone signal forming circuits each composed of a comb filter different in resonant frequency characteristics. In the resonant tone signal forming circuits, a plurality of resonant tone signals are formed in response to an input musical tone signal and mixed to be sounded from one or plural loudspeakers for electrically providing resonant effects caused by oscillation of plural strings as in a piano.

In a natural musical instrument such as a piano, a plurality of strings are aligned to resonate when one of the strings has been sounded by depression of a key. Thus, the resonant tones of the piano strings are sounded at different positions to effect spatial broadness in a musical tone. In such a conventional resonant effect apparatus as described above, however, a plurality of different resonant tone signals are applied to one loudspeaker to be sounded therefrom. For this reason, a musical tone applied with the resonant effects sounds unnatural due to lack of spatial broadness. In the conventional apparatus, the musical tone signals from the musical tone signal forming circuits are applied in common to each of the resonant tone signal forming circuits. Accordingly, the resonant tone signal forming circuits are applied with the musical tone signals at the same volume level irrespectively of the tone pitch thereof. This means that in the piano the oscillation of the sounded string affects the same influence to the resonance strings, irrespectively of the distance between the sounded string and the resonance strings. In this sense, the resonant tone obtained in the conventional apparatus becomes unnatural.

SUMMARY OF THE INVENTION

It is, therefore, a primary object of the present invention to provide an improved resonant effect apparatus for an electronic musical instrument wherein each sound localization of plural resonant tone signals is controlled to produce a natural resonant tone with spatial broadness.

A secondary object of the present invention is to provide an improved resonant effect apparatus for an electronic musical instrument wherein the resonant tone signals are formed in consideration with an influence of the tone pitch of a musical tone signal to be sounded for producing a natural resonant tone as in the piano.

According to the present invention, there is provided a resonant effect apparatus for providing a resonant effect to a musical tone in an electronic musical instrument, which comprises a plurality of resonant tone signal forming channels for forming a plurality of resonant tone signals different in their resonant frequency characteristics when applied with a musical tone signal to be generated, a plurality of acoustic conversion means for acoustically converting each of the resonant tone signals to issue the converted resonant tone signals therefrom, and control means for controlling a supply condition of the resonant tone signals to the acoustic conversion means for control of a sound localization of the resonant tone signals.

In an aspect of the present invention, the control means may comprise means for controlling each delay time of the resonant tone signals applied to the acoustic conversion means and/or means for controlling each tone volume level of the resonant tone signals applied to the acoustic conversion means.

In another aspect of the invention, there is provided a resonant effect apparatus for an electronic musical instrument including means for designating a tone pitch of a musical tone to be generated, musical tone forming means for forming a plurality of musical tone signals at different tone pitches designated by the designating means, and plurality of resonant tone signal forming channels for producing a plurality of resonant tone signals different in their resonant frequency characteristics in response to the musical tone signals applied thereto from the musical tone forming means, wherein weighting means is arranged at each input side of the resonant tone signal forming channels to weight the musical signals applied thereto from the musical tone signal forming means with a predetermined coefficient and to mix the weighted musical tone signals for applying the mixed musical tone signals to the resonant tone forming channels.

BRIEF DESCRIPTION OF THE DRAWINGS

The invention will now be described in more detail, by way of example, with reference to the drawings in which identical reference numerals refer to identical components.

In the drawings:

FIG. 1 is a block diagram illustrating the entire construction of an electronic musical instrument;

DESCRIPTION OF THE PREFERRED EMBODIMENTS

Figure 2:
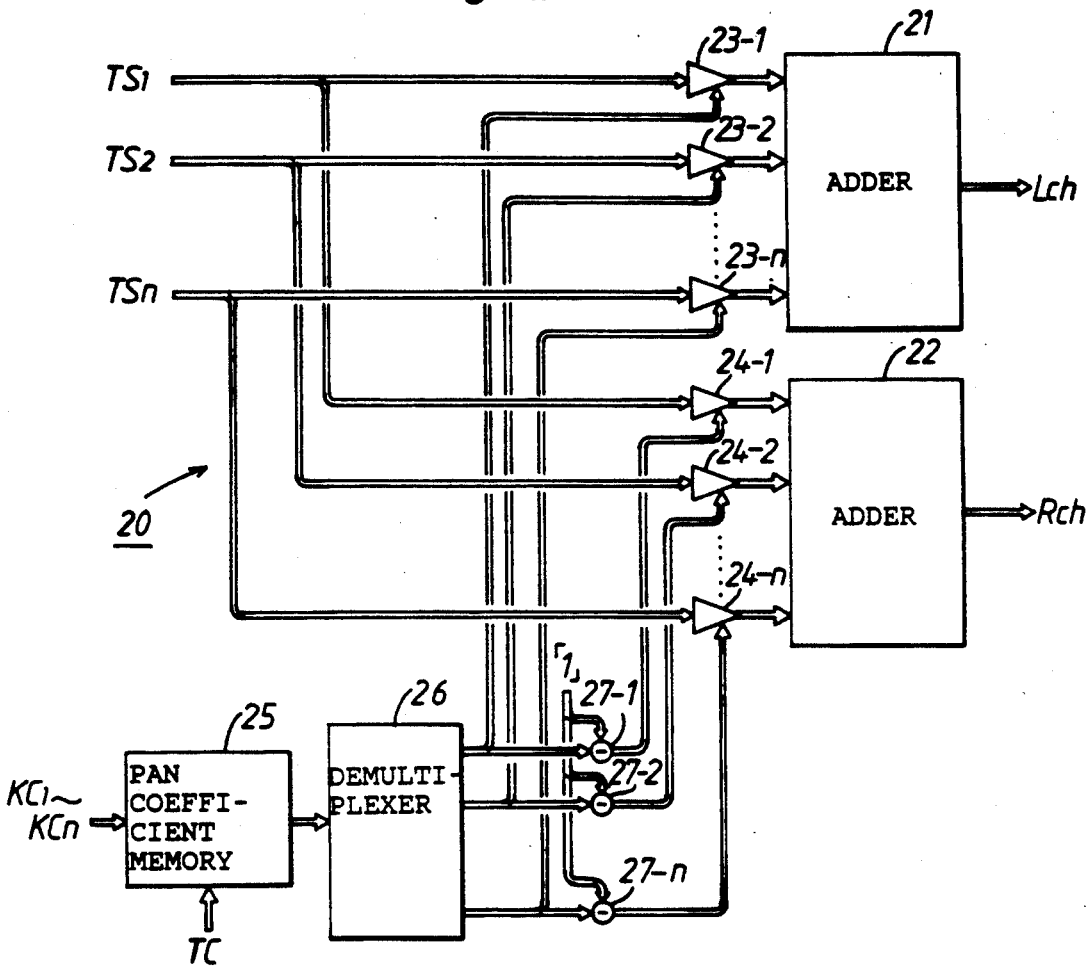
FIG. 2 is a block diagram of a mixing circuit shown in FIG. 1.

In FIG. 1 of the drawings, there is illustrated the entire construction of an electronic musical instrument according to the present invention. The electronic musical instrument has a key switch circuit 11 including a plurality of key switches which correspond with respective keys on a keyboard (not shown). The key switch 11 is connected to a depressed-key detection circuit 12 which is arranged to detect a depressed key or keys on the keyboard in response to on-off operation of the key switches in the key switch circuit 11 and to apply an electric signal indicative of the depressed key or keys to a key-assignor 13. The key-assignor 13 is designed to assign key codes $KC_1$–$KC_n$ indicative of the depressed key or keys and key-on signals $KO_1$–$KO_n$ indicative of the depressed or released conditions of the keys to a plurality of musical tone signal forming channels 14-1 to **14-*n*** at a time divisional multiplex timing synchronism with the assigned channels. The key codes $KC_1$–$KC_n$ each are defined as a small value when a musical tone is generated at a low pitch and increased in accordance with rise of the tone pitch.

Each of the musical tone signal forming channels 14-1 to **14-*n* includes an input circuit arranged to be applied with a key code KC and a key-on signal KO from the time divided key codes $KC_1$–$KC_n$ and key-on signals $KO_1$–$KO_n$ in synchronism with the assigned channels and a musical tone signal forming circuit arranged to produce a musical tone signal when applied with the key code KC and key-on signal KO from the input circuit. In this instance, the tone pitch of respective musical tone signals $TS_1$–$TS_n$ formed at the musical tone signal forming circuits is controlled by the key codes $KC_1$–$KC_n$, the tone color of the respective musical tone signals is defined by a tone color control parameter, and the tone volume envelope of the respective musical tone signals is defined by the key-on signals $KO_1$–$KO_n$ and a sustain signal SUS. The tone color control parameter is supplied from a tone color control parameter memory 15 which is arranged to memorize plural sets of tone color control parameters corresponding with a plurality of tone colors and to issue a set of tone color control parameters addressed by a tone color selection signal TC from a tone color selection switch circuit 16. The tone color selection switch circuit 16 is composed of a plurality of tone color selection switches which correspond with a plurality of tone color selection elements to issue a tone color selection signal TC indicative of a tone color selected by operation of the selection elements. The sustain signal SUS represents an operated condition of a sustain pedal (not shown), which is supplied from a sustain pedal switch 17** to be closed and opened by operation of the sustain pedal.

Figure 3:
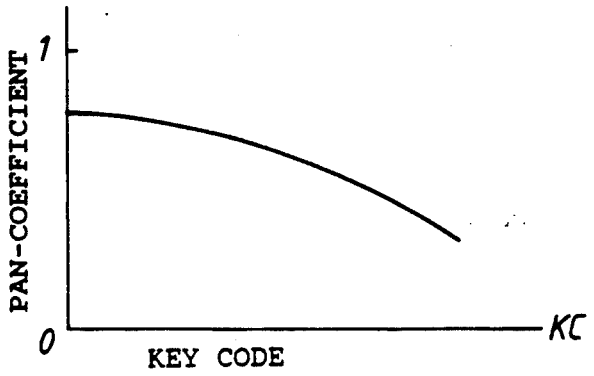
FIG. 3 is a graph showing a pan-coefficient in relation to a key code.

The musical tone signal forming channels 14-1 to **14-*n* are connected to a mixing circuit 20 which includes, as shown in FIG. 2, an adder 21 for a left channel and an adder 22 for a right channel. The adder 21 is connected at its input to a plurality of multipliers 23-1 to 23-*n*, while the adder 22 is connected at its input to a plurality of multipliers 24-1 to 24-*n*. The multipliers 23-1 to 23-*n* and 24-1 to 24*n* are arranged to determine a mixing ratio of input signals respectively applied to the adders 21, 22. The multipliers 23-1 to 23-*n* act to multiply the musical tone signals $TS_1$–$TS_n$ applied from the musical tone signal forming channels 14-1 to 14-*n* by pan-coefficients for the left channel tone source and to apply a resultant of the multiplication to the adder 21. The pan-coefficient for the left channel tone source is memorized as a plurality of pan-coefficients for each tone color in a pan-coefficient memory 25. For example, as shown in FIG. 3**, a set of pan-coefficients for a piano tone color is determined to be less than "1" at a lowest key code KC and to be decreased in accordance with an increase of key code KC. In the case that a different tone color is selected, the pan-coefficients are determined substantially in the same manner as those of the piano tone color but the characteristic curve of the pan-coefficients will differ.

The pan-coefficient memory 25 is arranged to be supplied with the time divided key codes $KC_1$–$KC_n$ from the key assignor 13 and the tone color selection signal TC from the tone color selection switch circuit 16 as an address signal thereto. Thus, the pan-coefficient memory 25 designates a set of pan-coefficients in response to the tone color selection signal TC to issue therefrom a pan-coefficient included in the designated set of pan-coefficients and respectively designated by the key-codes $KC_1$–$KC_n$. The pan-coefficient memory 25 is connected at its output to a demultiplexer 26 which is arranged to demultiplex the pan-coefficients applied thereto from the pan-coefficient memory 25 at a timing defined by the key-codes $KC_1$–$KC_n$ and to apply the demultiplexed pan-coefficients to the multipliers 23-1 to **23-*n***.

The multipliers 24-1 to **24-*n* act to multiply the musical tone signals $TS_1$–$TS_n$ from the musical tone signal forming channels 14-1 to 14-*n* by pan-coefficients for the right channel and to apply a resultant of the multiplication to the adder 22. The pan-coefficients for the right channel are calculated by subtraction of the pan-coefficient for the left channel from "1" at subtractors 27-1 to 27-*n*. As shown in FIG. 1, the mixing circuit 20 is connected at its outputs to left and right loudspeakers 37, 38 for the production of sound respectively through adders 31, 32, digital-to-analog converters 33, 34 and amplifiers 35, 36. The loudspeakers 37, 38 are mounted on a front panel of the electronic musical instrument at its left and right sides or installed on a stage, studio or the like at its left and right sides. The adders 31, 32 are supplied with a resonant tone signal respectively for the left and right channels formed at a resonant tone signal forming portion 40** in response to the musical tone signal applied thereto.

Figure 4:
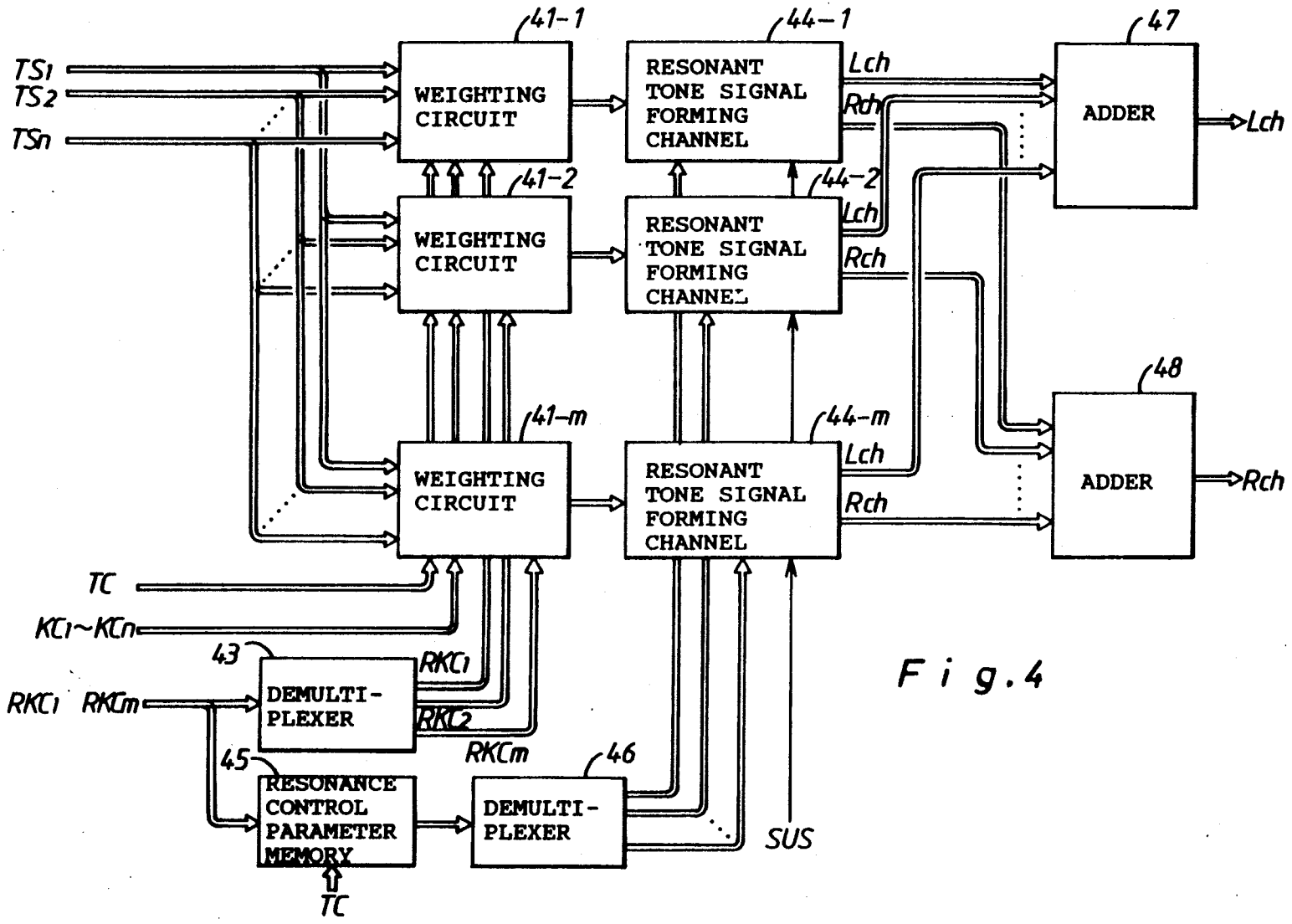
FIG. 4 is a block diagram of a resonant tone signal forming portion shown in FIG. 1.

The resonant tone signal forming portion 40 is designed to produce the number m of resonant tone signals different in their resonant frequency characteristics when applied with the musical tone signal. As shown in FIGS. 1 and 4, the resonant tone signal forming portion 40 includes the number m of weighting circuits 41-1 to **41-*m* which are arranged to be simultaneously applied with the musical tone signals $TS_1$–$TS_n$ from the musical tone signal forming channels 14-1 to 14-*n*, the tone color selection signal TC from the tone color selection switch 16 and the time divided key codes $KC_1$–$KC_n$ from the key assignor 13. The weighting circuits 41-I to 41-*m* each are further applied with resonant frequency data $RKC_1$–$RKC_m$ from a resonant frequency data generator 42 through a demultiplexer 43. In this embodiment, the resonant frequency data $RKC_1$–$RKC_m$ correspond with each resonant frequency of strings in a piano or the like. The resonant frequency data generator 42 has a memory storing the number m of resonant frequencies for each tone color and is designed to generate the number m of resonant frequency data $RKC_1$–$RKC_m$ designated by the tone color selection signal TC from the tone color selection switch circuit 16. The demultiplexer 43 is designed to demultiplex the resonant frequency data $RKC_1$–$RKC_m$ in correspondence with the weighting circuits 41-1 to 41-*m***.

Figure 5:
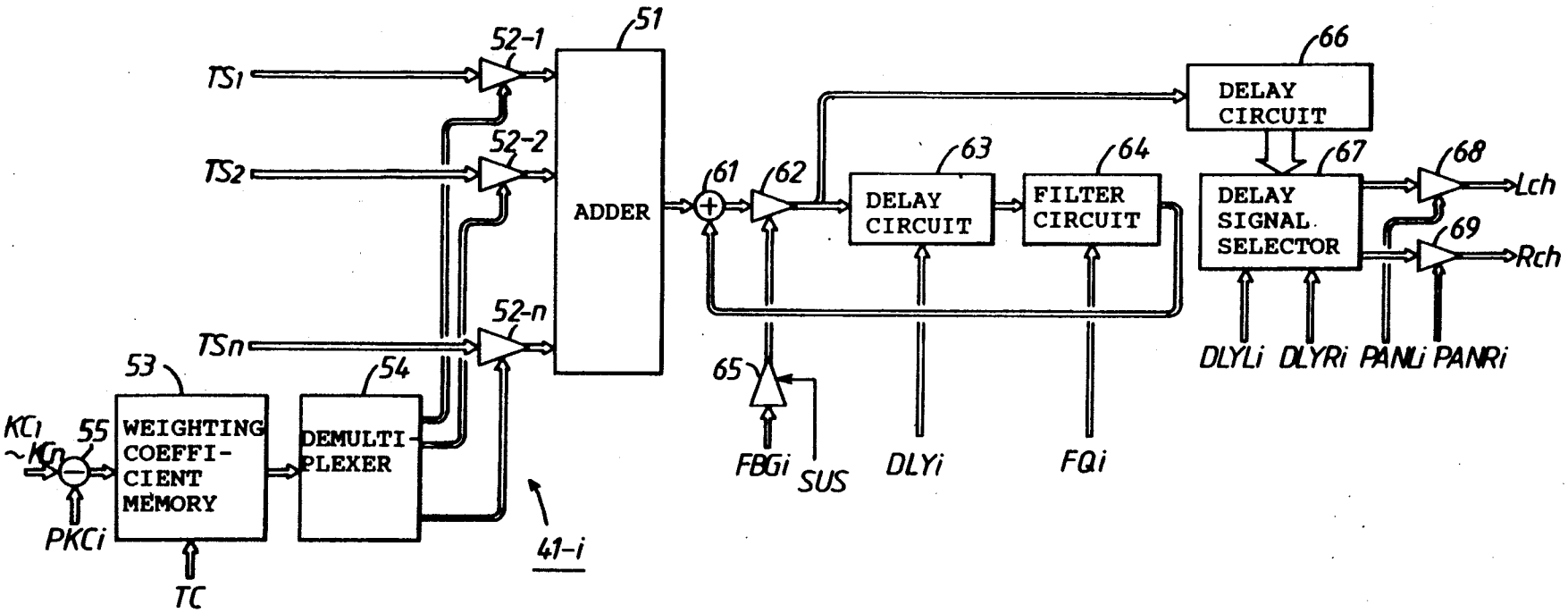
FIG. 5 is a block diagram of a weighting circuit and a resonant tone signal forming channel shown in FIG. 4.
Figure 6:
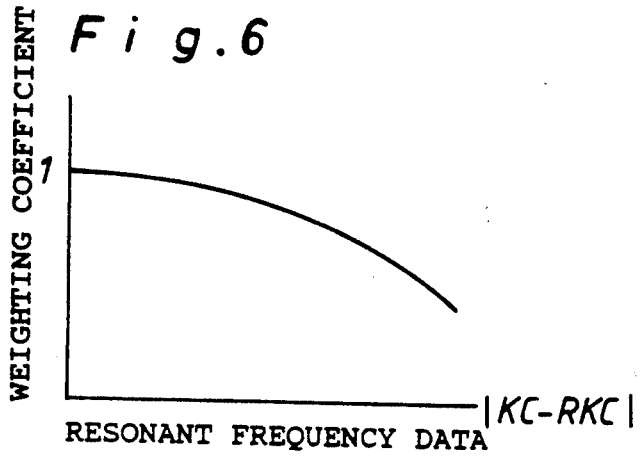
FIG. 6 is a graph showing a weighting coefficient in relation to resonant frequency data.

In FIG. 5, one of the weighting circuits 41-1 to **41-*m* is illustrated as a weighting circuit 41-i which includes an adder 51 for summing up the musical tone signals $TS_1$–$TS_n$ applied thereto from the musical tone signal forming channels 14-1 to 14-*n* through multipliers 52-1 to 52-*n* for determining a tone volume level of the input signals applied to the adder 51. The multipliers 51-1 to 52-*n* are applied with a weighting coefficient from a weighting coefficient memory 53 through a demultiplexer 54 for multiplying the musical tone signals $TS_1$-$TS_n$ by the weighting coefficient and applying a resultant of the multiplication to the adder 51. The weighting coefficient memory 53 is designed to store all sets of weighting coefficients for each tone color. For example, as shown in FIG. 6**, a set of weighting coefficients corresponding with a piano tone color are determined to be "1" when the absolute value of the difference between the key code KC and resonant frequency RKC is "0" and to be decreased in accordance with an increase of the absolute value IKC-RKCI. In the case that a different tone color from the piano tone color is selected, the weighting coefficients are determined substantially in the same manner as those in the piano tone color, but the characteristic curve will differ.

The weighting coefficient memory 53 is addressed by the tone color selection signal TC and is further addressed by an input signal from a subtractor 55. The subtractor 55 is applied with the time divided key codes $KC_1$-$KC_n$ from the key assignor 13 and resonant frequency data RKCi from the respective key codes $KC_1$-$KC_n$ for applying signals respectively indicative of $KC_1-RKCi$, $KC_2-RKCi$ . . . $KC_n-RKCi$ to the weighting coefficient memory 53. The demultiplexer 54 is arranged to demultiplex the weighting coefficient applied thereto from the weighting coefficient memory 53 at a timing defined by the time divided key codes $KC_1$-$KC_n$ and to apply a resultant value of the demultiplication to the multipliers 52-1 to **52-*n***.

Referring back to FIG. 4, the weighting circuits to **41-*m* are connected in series with resonant tone signal forming channels 44-1 to 44-*m* which are arranged to be simultaneously supplied with the sustain signal SUS from the sustain pedal switch 17 and to be individually supplied with a resonance control parameter. The resonance control parameter includes, as one set, a delay control parameter DLY, a feedback-gain parameter FBG, a filter characteristic parameter FQ, left and right delay parameters DLYL, DLYR for pan control, and left and right tone volume parameters PANL, PANR for pan control. The one set of the respective parameters is memorized in a resonance control parameter memory 45 for each tone color and each of the resonant frequency data $RKC_1$-$RKC_m$. The nature of the respective parameters will be described later in the specific description of the resonant tone signal forming channels 44-1 to 44-*m*. The resonance control parameter memory 45 is addressed by the tone color selection signal TC from the tone color selection switch circuit 16 and the resonant frequency data $RKC_1$-$RKC_m$ from the resonant frequency data generator 42 to issue the number m of resonance control parameters corresponding with the selected tone color and the resonant frequencies of the respective resonant tone signal forming channels 44-I to 44-*m* at a time divisional multiplex timing. The resonance control parameter memory 45 has an output connected to a demultiplexer 46 which is arranged to demultiplex the number m of resonance control parameters in correspondence with the time divided timing of the frequency data $RKC_1$-$RKC_m$ and the respective resonant tone signal forming channels 44-1 to 44-*m* and to apply the demultiplexed control parameters to the resonant tone signal forming channels 44-1 to 44-*m***, respectively.

In FIG. 5, one of the resonant tone signal forming channels 44-1 to **44-*m* is illustrated as a channel 44-i in the form of a comb filter provided with a signal circulating circuit including an adder 61, a multiplier 62, a delay circuit 63 and a filter circuit 64. The adder 61 is arranged to add an input signal from the adder 51 of weighting circuit 41-i to a signal fed back thereto through the multiplier 62, delay circuit 63 and filter circuit 64 and to supply it to the multiplier 62. The multiplier 62 controls the feedback gain of the circulating signal under control of a feedback gain parameter FBGi. Disposed in the input line of the feedback gain parameter FBGi to the multiplier 62 is a multiplier 65 which is arranged to multiply the feedback gain parameter FBGi by the sustain signal SUS ("0" or "1") and to apply a resultant of the multiplication to the multiplier 62. The delay circuit 63 is controlled by a delay control parameter DLYi applied thereto to delay the input signal from the multiplier 62 with the time defined by the parameter DLYi for determining a resonant frequency of the resonant tone signal forming channel 44-*i*. The filter circuit 64** is controlled by a filter characteristic parameter FQi to determine a frequency characteristics of the circulating signal such as a filter characteristic and a cut-off frequency of a low-pass, a band-pass or the like.

Figure 7:
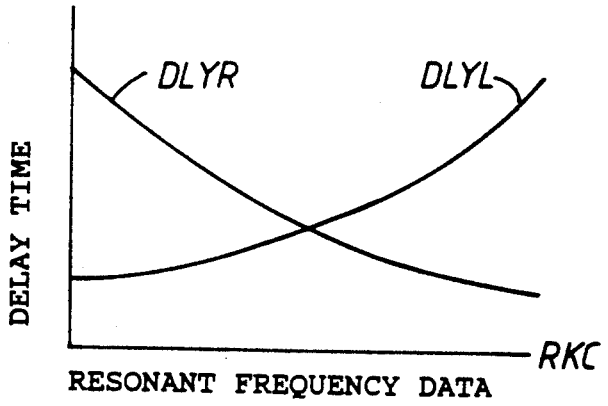
FIG. 7 is a graph showing a delay time in relation to resonant frequency data.
Figure 8:
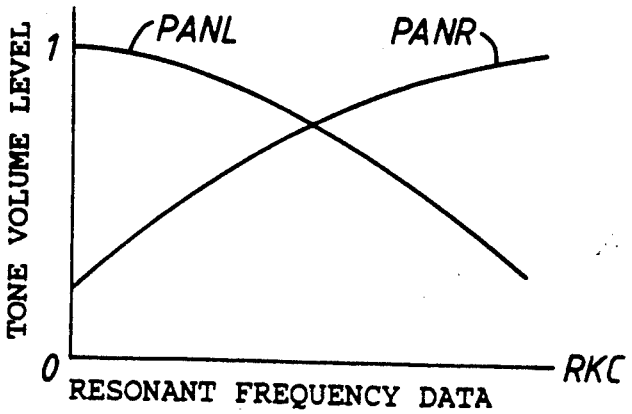
FIG. 8 is a graph showing a tone volume level in relation to resonant frequency data.

The output of multiplier 62 is further connected to a delay circuit 66 which is arranged to delay the input signal with several ten milliseconds at a maximum for issuing a number of signals delayed with a different time from zero to several ten milliseconds. The number of signals are applied to a delay signal selector 67 which is controlled by the left and right delay parameters DLYLi, DLYRi for pan control to issue two signals each delayed with a time defined by the parameters DLYLi, DLYRi as a resonant sound signal respectively for the left and right channels. The left and right delay parameters DLYLi, DLYRi for pan control slightly differ at each tone color. As shown in FIG. 7, the delay parameter DLYLi is determined to gradually increase in accordance with an increase of the resonant frequency data RKC, while the delay parameter DLYRi is determined to gradually decrease in accordance with an increase of the resonant frequency data RKC. The delay signal selector 67 is connected at its outputs to multipliers 68 and 69 which are arranged to multiply the input signal from delay circuit 66 by the left and right tone volume parameters PANLi, PANRi for pan control and to issue a resultant of the multiplication as a resonant tone signal respectively for the left and right channels. The left and right tone volume parameters PANLi, PANRi slightly differ at each tone color. As shown in FIG. 8, the left tone volume parameter PANLi is determined to gradually decrease in accordance with an increase of the resonant frequency data RKC, while the right tone volume parameter PANRi is determined to gradually increase in accordance with an increase of the resonant frequency data RKC.

The multiplier 68 of the respective resonant tone signal forming channels 44-1 to **44-*m* is connected at its output to an adder 47 as shown in FIG. 4. The adder 47 is arranged to sum up the input signals applied thereto for issuing them as a resonant tone signal for the left channel. The multiplier 69 of the resonant tone signal forming channels 44-1 to 44-*m* is connected at its output to an adder 48 which is arranged to sum up the input signals applied thereto for issuing them as a resonant tone signal for the right channel. The resonant tone signals for the left and right channels are applied to the adders 31 and 32 respectively, as shown in FIG. 2**.

Hereinafter, the operation of the electronic musical instrument will be described. Assuming that the keys on the keyboard have been performed, the depressed key detection circuit 12 detects on-off operation of the respective key switches in the key switch circuit 11 and supplies information with respect to the depressed and released keys to the key assignor 13. Thus, the key assignor 13 assigns the information of the depressed and released keys to any of the musical tone signal forming channels 14-1 to **14-*n* and produces key codes $KC_1$–$KC_n$ and key-on signals $KO_1$–$KO_n$ corresponding to the depressed key or keys at the time divisional multiplex timing in synchronism with the assigned channels for applying the key codes $KC_1$–$KC_n$ and key-on signals $KO_1$–$KO_n$ to the assigned channels 14-1 to 14-*n*. The assigned channels 14-1 to 14-*n* produce musical tone signals $TS_1$–$TS_n$ at a tone pitch defined by the key codes $KC_1$–$KC_n$ and apply the musical tone signals $TS_1TS_n$ to the mixing circuit 20. In this instance, the tone color of the musical tone signals $TS_1$–$TS_n$ is controlled by the tone color control parameter from the tone color control parameter memory 15 to correspond with a tone color selected at the tone color selection switch circuit 16. The tone volume envelope of the musical tone signals is controlled by the key-on signals $KO_1$–$KO_n$ to rise in response to the depression of the key or keys on the keyboard and to gradually attenuate in response to release of the depressed key or keys. The tone volume envelope is further controlled by the sustain signal SUS from the sustain pedal switch 17**. The attenuation time of the tone volume envelope becomes long when the sustain signal SUS is maintained at a high level by depression of the sustain pedal and becomes short when the sustain signal SUS is maintained at a low level by release of the sustain pedal.

The musical tone signals $TS_1$–$TS_n$ applied to the mixing circuit 20 are applied to the multipliers 23-1 to **23-*n* and to the multipliers 24-1 to 24-*n* as shown in FIG. 2. In this instance, the pan-coefficients for the left channel are read out from the pan-coefficient memory 25 in accordance with the tone color selection signal TC and the key codes $KC_1$–$KC_n$ and applied to the multipliers 23-1 to 23-*n* through the demultiplexer 26 respectively. Thus, the multipliers 23-1 to 23-*n* multiply the musical tone signals $TS_1$–$TS_n$ by the pan-coefficients for the left channel respectively and apply a resultant of the multiplication to the adder 21. As a result, the musical tone signals $TS_1$–$TS_n$ are weighted by the pan-coefficients for the left channel corresponding to their tone pitch and applied to the adder 21. Since the pan-coefficients for the left channel are determined to decrease in accordance with an increase of the key code KC or tone pitch as shown in FIG. 3, the musical tone signals $TS_1$–$TS_n$ are applied to the adder 21** at a large tone volume level when they are produced at a low octave.

On the other hand, the subtractors 27-1 to **27-*n* act to subtract the pan-coefficients for the left channel from, "1" and apply a resultant value of the subtraction to the multipliers 24-1 to 24-*n*. Thus, the complement of the pan-coefficients for the left channel is applied to the multipliers 24-1 to 24-*n* as a pan-coefficient for the right channel. As a result, the musical tone signals $TS_1$–$TS_n$ are weighted by the pan-coefficient for the right channel corresponding to the tone pitch or key code KC and applied to the adder 22. Since the complement of the pan-coefficients for the left channel is determined to increase in accordance with the rise of the tone pitch or an increase of the key code KC, the musical tone signals $TS_1$–$TS_n$ are applied to the adder 22** at a large volume level when they are produced at a high octave.

The musical tone signals $TS_1$–$TS_n$ applied to the adders 21, 22 are each summed up and applied as a musical tone signal respectively for the left and right channels to the digital-to-analog converters 33, 34 through the adders 31, 32 to be converted into analog musical tone signals (see FIG. 2). The analog musical tone signals are applied to the loudspeakers 37, 38 through the amplifiers 35, 36 to be sounded therefrom. In this instance, the low pitch musical tone is sounded at a large volume from the speaker 37 for the left channel and sounded at a small volume from the speaker 38 for the right channel, while the high pitch musical tone is sounded at a small volume from the speaker 37 for the left channel and sounded at a large volume from the speaker for the right channel. Thus, the low octave sound image appears at the left side, while the high octave sound image appears at the right side.

During the operation described above, the musical tone signals from the musical tone signal forming channels 14-1 to **14-*n* are also supplied to the resonant tone signal forming portion 40, in which the musical tone signals $TS_1$–$TS_n$ are summed up by the number m of weighting circuits 41-1 to 41-*m* and applied to the number m of the resonant tone signal forming channels 44-1 to 44-*m* to produce the number m of different resonant tone signals (see FIG. 4). In the weighting circuits 41-1 to 41-*m* , as shown in FIG. 5, the musical tone signals $TS_1$–$TS_n$ are simultaneously applied to the multipliers 52-1 to 52-*n*. In this instance, the subtractor 55 acts to subtract the resonant frequency data RKC from the key codes $KC_1$–$KC_n$ and to apply a resultant value of the subtraction ($KC_1-RKCi$ to $KC_n-RKCi$) to the weighting coefficient memory 53 at the time divisional multiplex timing. Thus, the weighting coefficient memory 53 produces a weighting coefficient addressed respectively by the tone color selection signal TC and the output signal of the subtractor 53. The weighting coefficient is applied to the multipliers 52-1 to 52-*n* through the demultiplexer 54 at the time divisional multiplex timing assigned by the key codes $KC_1$–$KC_n$. As a result, the musical tone signals $TS_1$–$TS_n$ from the musical tone signal forming channels 14-1 to 14-*n* are weighted in accordance with a difference between the tone pitch or the key code KC and the resonant frequency data RKCi and applied to the adder 51. As shown in FIG. 6, the weighting coefficient is determined to decrease in accordance with increase of an absolute value $IKC_1-RKCiI$ to $ICK_n-RKCiI$ of each difference between the key codes $KC_1$–$KC_n$ and the resonant frequency data RKCi. For this reason, the musical tone signals $TS_1$–$TS_n$ are applied to the adder 51 at a large tone volume level when the absolute value $IKC_1-RKCiI$ to $IKC_n-RKCiI$ is determined to be a small value. In this embodiment, the absolute value $IKC_1-RKCiI$ to $IKC_nRKCiI$ corresponds with a distance between an oscillation element to be positively oscillated for generating a sound and another oscillation element resonating with the oscillated element, for example, a distance between a sounded string and a resonant string in a piano, and the weighted musical tone signals $TS_1TS_n$ are summed up at the adder 51**. As a result, the weighting of the musical tone signals is effective to affect an influence of the sounded string to the resonant string in inverse proportion to the distance between the strings.

As described above, the number m of the musical tone signals respectively summed up at the weighting circuits 41-1 to **41-*m* are applied to the circulating signal line including the adder 61, multiplier 62, delay circuit 63 and filter circuit 64 of the respective resonant tone signal forming channels 44-1 to 44-*m*. On the other hand, the multiplier 62, delay circuit 63 and filter circuit 64 each are applied with the feedback control parameter FBGi, delay control parameter DLYi and filter characteristic parameter FQi, and the multiplier 65 is applied with the sustain signal SUS from the sustain pedal switch 17. Assuming that the multiplier 65 is applied with the sustain signal SUS at a low level under a released condition of the sustain pedal, the multiplier 62 does not apply the musical tone signal from the adder 61 to the delay circuit 66 since it is applied with a low level control signal from the multiplier 65. In such a condition, the resonant tone signal forming portion 40** does not produce any musical tone signal therefrom.

When the multiplier 65 is applied with the sustain signal SUS at a high level in response to depression of the sustain pedal, the multiplier 62 multiplies an input signal from the adder 61 by the feedback gain parameter FBGi applied thereto from the multiplier 65 and applies a resultant of the multiplication to the delay circuit 63. Thus, the musical tone signal circulates through the signal circulating circuit including the adder 61, multiplier 62, delay circuit 63 and filter circuit 64. The circulation of the musical tone signal through the signal circulating circuit is maintained after disappearance of the musical tone signal from the adder 51. Thus, the circulating signal is continually supplied to the delay circuit 66 as a resonant tone signal. In this instance, the delay control parameter $DLY_1$-$DLY_m$ and filter characteristic parameter $FBG_1$-$FBG_m$ are applied to the delay circuit 63, filter circuit 64 and multiplier 62 of the respective resonant tone signal forming channels 44-1 to **44-*m*. Since the parameters are specified to correspond with the tone color selection signal TC and resonant frequency data $RKC_1RKC_m$ under operation of the resonance control parameter memory 45 and demultiplexer 46, the resonant tone signal forming channels 44-1 to 44-*m*** each are applied with a resonant effect at a frequency corresponding with the respective resonant frequencies $RKC_1$-$TKC_m$. Thus, the resonant effect is obtained as in a piano the plural strings of which act as a resonant element, respectively.

During the operation described above, the delay circuit 66 is applied with the multiplied signal from the multiplier 62 to issue a plurality of signals delayed by a different time. In turn, the delay signal selector 67 reads out the delayed signals from the delay circuit 66 respectively under control of the left and right delay parameters DLYLi, DLYRi and applies them to the multipliers 68 and 69. The multipliers 68, 69 multiply the delayed signals respectively by the left and right tone volume parameters PANLi, PANRi for pan control to issue the multiplied signals as resonant tone signals for the left and right channels. Since the left and right delay parameters $DLYL_1$-$DLYL_m$, $DLYR_1$-$DLYR_m$, and tone volume parameters $PANL_1$-$PANL_m$, $PANR_1$-$PANR_m$ are specified to correspond with the tone selection signal TC and resonant frequency data $RKC_1$-$RKC_m$ under operation of the resonance control parameter memory 45 and demultiplexer 46, the resonant tone signal forming channels 44-1 to **44-*m*** each produce a resonant tone signal delayed with a different time at a different tone volume level for the left and right channels.

Since the left and right delay parameters DLYL1-$DLYL_m$, DLYR1-$DYLR_m$ and tone volume parameters PANL1-$PANL_m$, PANR1-$PANR_m$ are determined as shown in FIGS. 7 and 8, the delay time of the resonant tone signal for the left channel becomes long in accordance with an increase of the resonant frequency data $RKC_1$-$RKC_m$ while the delay time of the resonant tone signal from the right channel becomes short, and the tone volume level of the resonant tone signal for the left channel becomes small in accordance with an increase of the resonant frequency data $RKC_1$-$RKC_m$ while the tone volume level of the resonant tone signal for the right channel becomes large. The resonant tone signals for the left and right channels are summed up at the adders 47, 48 and applied to the adders 31, 32 to be added to the musical tone signals $TS_1$-$TS_n$ from the mixing circuit 20. Thus, the sound image of the resonant tone corresponding to a high octave tone are located at the right side in phase and volume. As a result, a spatial acoustic effect of the resonant tone is realized as in a musical instrument such as a piano.

In actual practice of the present invention, the above embodiment may be modified as described below.

1) Although the musical tone signal forming channels 41-1 to **14-*n* and the resonant tone signal forming channels 44-1 to 44-*m* have been formed in a plurality of spatially separated circuits, the signal forming channels 14-1 to 14-*n* and 44-1 to 44-*m* may be formed in a plurality of time divisional process circuits. In such a case, the number n of time divisional channels corresponding with the signal forming channels 14-1 to 14-*n* are adapted to produce time divisional musical tone signals in accordance with the key codes $KC_1$-$KC_n$, key-on signals $KO_1$-$KO_n$ and sustain signal SUS. On the other hand, the number m of time divisional channels corresponding with the signal forming channels 44-1 to 44-*m* are adapted to be synchronously applied with the various resonance control parameters for processing a calculation with respect to the formation of resonant tone signals. In addition, the weighting circuits 41-1 to 41-*m*** each are designed to have a time divisional channel for weighting the number n of musical tone signals $TS_1$-$TS_n$ at each of the number m of resonant tone forming channels.

2) Although the weighting circuits 41-1 to **41-*m* and resonant tone signal forming channels 44-1 to 44-*m* have been controlled by the resonant frequency data $RKC_1$-$RKC_m$ from the resonant frequency data generator 42 and the resonance control parameters from the resonance control parameter memory 45 to provide a specific characteristic for the respective circuits, the weighting circuits 41-1 to 41-*m* and resonant tone signal forming channels 44-1 to 44-*m* each may be arranged to have a predetermined specific characteristic. In this case, the resonant frequency for each of the weighting circuits 41-1 to 41-*m* can be primarily determined without provision of the subtractor 55 shown in FIG. 1. A memory is adapted to memorize a different weighting coefficient representing a relationship between respective resonant frequencies for the weighting circuits 41-1 to 41-*m*** and the key codes $KC_1$-$KC_n$ thereby to read out the weighting coefficient in accordance with the key codes $KC_1$-$KC_n$.

3) In the respective resonant tone signal forming channels 44-1 to **44-*m*, the adder 61, multiplier 62, delay circuit 63 and filter circuit 64 are connected in sequence to form a signal circulating circuit and to issue an output signal from a portion between the multiplier 62 and delay circuit 63. In the case, however, that the delay of the resonant tone signal does not cause any problems, the adder 61, delay circuit 63, filter circuit 64 and multiplier 62 may be connected in sequence to issue an output signal from a portion between the multiplier 62 and adder 61**.

4) Although in the above embodiment, the musical tone signals $TS_1$–$TS_n$ each are applied with the resonant effect only in depression of the sustain pedal, the resonant effect may be continually controlled in accordance with depression of the sustain pedal. In this case, a variable resistor is substituted for the sustain pedal switch 17 to detect a depression amount of the sustain pedal for applying an electric signal indicative of the depression amount to the musical tone signal forming channels 14-1 to **14-*n* and the multiplier 65 of the resonant tone signal forming channels 44-1 to 44-*n***.

5) Although in the above embodiment all the control parameters have been memorized respectively in the pan-coefficient memory 25, resonance control parameter memory 45 and weighting coefficient memory 53, some of the control parameters may be interpolated to reduce the number of the memories.

6) Although in the above embodiment the spatial localization of the resonant tone has been realized by both the time delay control and the volume level control of the resonant tone signals for the left and right channels, either one of the time delay control and the volume level control may be adapted to realize the spatial localization of the resonant tone.

7) Although in the above embodiment the acoustic channel has been provided in the form of two channels for controlling the sound localization of the musical tone signals and the resonant tone signals, the acoustic channel may be provided in the form of channels exceeding three channels for control of the sound localization.

What is claimed is:

1. A resonant effect apparatus for providing a resonant effect to a musical tone in an electronic musical instrument, comprising:

a plurality of resonant tone signal forming channels for forming a plurality of resonant tone signals different in their resonant frequency characteristics when applied with a musical tone signal to be generated;

memory means for memorizing a plurality of resonance control parameters for control of each sound localization of the resonant tone signals;

control means for controlling each of the resonant tone signals based on the memorized resonance control parameters; and a plurality of acoustic conversion means for acoustically converting each of the controlled resonant tone signals to issue the converted resonant tone signals therefrom.

2. A resonant effect apparatus as recited in claim 1, wherein said control means comprises means for delaying the resonant tone signals with a different time defined by the memorized resonance control parameters.

3. A resonant effect apparatus as recited in claim 1, wherein said control means comprises means for controlling each tone volume level of the resonant tone signals based on the memorized resonance control parameters.

4. A resonant effect apparatus as recited in claim 1, wherein said memory means comprises means for memorizing a plurality of delay parameters for pan control and a plurality of tone volume parameters for pan control.

5. A resonant effect apparatus for an electronic musical instrument including means for designating a tone pitch of a musical tone to be generated, musical tone forming means for forming a plurality of musical tone signals at different tone pitches designated by said designating means, and a plurality of resonant tone signal forming channels for producing a plurality of resonant tone signals different in their resonant frequency characteristics in response to the musical tone signals applied thereto from said musical tone forming means, wherein weighting means is arranged at each input side of said resonant tone signal forming channels to weight the musical tone signals applied thereto from said musical tone signal forming means in accordance with a difference between each tone pitch of the musical tone signals and each resonant frequency data for control of the resonant tone signals and to mix the weighted musical tone signals for applying the mixed musical tone signals to said resonant tone signal forming channels.

* * * * *